US008342161B2

(12) United States Patent
Harwath et al.

(10) Patent No.: US 8,342,161 B2
(45) Date of Patent: Jan. 1, 2013

(54) ARROW REST

(75) Inventors: Frank A. Harwath, Naperville, IL (US); Robert S. Mizek, Downers Grove, IL (US)

(73) Assignee: New Archery Products Corp., Forest Park, IL (US)

( * ) Notice: Subject to any disclaimer, the term of this patent is extended or adjusted under 35 U.S.C. 154(b) by 156 days.

(21) Appl. No.: 12/016,742

(22) Filed: Jan. 18, 2008

(65) Prior Publication Data

US 2008/0173290 A1 Jul. 24, 2008

Related U.S. Application Data

(60) Provisional application No. 60/881,736, filed on Jan. 18, 2007.

(51) Int. Cl.
*F41B 5/22* (2006.01)

(52) U.S. Cl. ..... 124/44.5; 124/41.1; 124/86; 124/87

(58) Field of Classification Search ..... 124/44.5, 124/41.1, 86, 87
See application file for complete search history.

(56) References Cited

U.S. PATENT DOCUMENTS 3,865,096 A * 2/1975 Troncoso, Jr. ..... 124/24.1
3,935,854 A * 2/1976 Troncosco, Jr. ..... 124/24.1
4,236,497 A * 12/1980 Troncoso, Jr. ..... 124/24.1
4,686,956 A * 8/1987 Troncoso, Jr. ..... 124/44.5
4,748,964 A * 6/1988 Troncoso, Jr. ..... 124/44.5
4,809,670 A * 3/1989 Simo ..... 124/44.5
4,827,895 A * 5/1989 Troncoso, Jr. ..... 124/44.5
4,862,867 A * 9/1989 Schmidt ..... 124/41.1
4,867,129 A * 9/1989 Scherz ..... 124/41.1
4,899,716 A * 2/1990 Martin et al. ..... 124/44.5
4,947,823 A * 8/1990 Larson ..... 124/41.1
4,949,699 A * 8/1990 Gerber ..... 124/44.5
4,967,722 A * 11/1990 Roberts ..... 124/44.5
5,009,215 A * 4/1991 Ludwig ..... 124/44.5
5,025,773 A * 6/1991 Hintze et al. ..... 124/44.5
5,042,450 A * 8/1991 Jacobson ..... 124/44.5
5,062,407 A * 11/1991 Newbold ..... 124/44.5
5,065,731 A * 11/1991 Smith ..... 124/44.5
5,070,855 A * 12/1991 Troncoso ..... 124/44.5
5,085,201 A * 2/1992 Tepper et al. ..... 124/44.5
5,095,884 A * 3/1992 Mertens ..... 124/44.5
5,103,797 A * 4/1992 Newbold ..... 124/44.5
5,117,803 A * 6/1992 Johnson ..... 124/44.5
5,123,395 A * 6/1992 Saunders ..... 124/44.5
5,137,006 A * 8/1992 Gallops ..... 124/44.5
5,161,515 A * 11/1992 Hammonds ..... 124/44.5
5,181,502 A * 1/1993 Ray ..... 124/44.5
5,213,090 A * 5/1993 Tone ..... 124/44.5
5,245,980 A * 9/1993 Colvin ..... 124/24.1
5,249,565 A * 10/1993 Saunders et al. ..... 124/44.5
5,251,606 A * 10/1993 Colvin ..... 124/44.5
5,253,633 A * 10/1993 Sisko ..... 124/44.5
5,280,777 A * 1/1994 Pugh ..... 124/52
5,285,764 A 2/1994 Mertens
5,325,839 A * 7/1994 Scheffer ..... 124/44.5
5,372,119 A * 12/1994 Kidney ..... 124/44.5

(Continued)

*Primary Examiner* — Gene Kim
*Assistant Examiner* — Alexander Niconovich
(74) *Attorney, Agent, or Firm* — Pauley Petersen & Erickson

(57) ABSTRACT

An arrow rest for an archery bow includes a frame and a vertical post extending upwardly from the frame so that the frame at least partially encircles the vertical post to form an arrow shaft pass-through. The arrow rest further includes a pair of spring arms, brushes and/or rollers extending generally toward the arrow shaft pass-through.

9 Claims, 7 Drawing Sheets

U.S. PATENT DOCUMENTS 5,383,441 A * 1/1995 Lightcap, Jr. ..... 124/44.5
5,385,135 A * 1/1995 Saunders ..... 124/44.5
5,394,858 A * 3/1995 Karolian ..... 124/44.5
5,400,763 A * 3/1995 Mazza ..... 124/44.5
5,419,303 A * 5/1995 Stewart ..... 124/44.5
5,421,314 A * 6/1995 Kidney ..... 124/44.5
5,447,284 A * 9/1995 Heinz ..... 124/44.5
5,460,152 A * 10/1995 Specht ..... 124/44.5
5,467,759 A * 11/1995 Troncoso ..... 124/44.5
5,476,086 A * 12/1995 Smith ..... 124/44.5
5,482,025 A * 1/1996 Finkel ..... 124/44.5
5,490,491 A * 2/1996 Troncoso ..... 124/44.5
5,503,136 A * 4/1996 Tone ..... 124/44.5
5,526,800 A * 6/1996 Christian ..... 124/44.5
5,529,049 A * 6/1996 Antalosky ..... 124/44.5
5,603,309 A * 2/1997 Sheliga ..... 124/44.5
5,606,962 A * 3/1997 Troncoso ..... 124/44.5
5,673,678 A * 10/1997 Savage ..... 124/44.5
5,678,530 A * 10/1997 Van Drielen ..... 124/44.5
5,685,287 A * 11/1997 Greywall ..... 124/44.5
5,722,381 A * 3/1998 Mizek ..... 124/44.5
5,743,245 A * 4/1998 Mizek ..... 124/44.5
5,855,200 A * 1/1999 Jessee ..... 124/44.5
5,896,849 A * 4/1999 Branthwaite et al. ..... 124/44.5
5,960,779 A * 10/1999 Jessee et al. ..... 124/44.5
6,021,769 A * 2/2000 Troncoso ..... 124/44.5
6,050,251 A * 4/2000 Harwath et al. ..... 124/44.5
6,202,635 B1 * 3/2001 Evans ..... 124/44.5
6,363,924 B1 * 4/2002 Adams, Jr. ..... 124/44.5
6,505,619 B2 * 1/2003 Hulm ..... 124/44.5
6,557,541 B2 * 5/2003 Pinto, Jr. ..... 124/44.5
6,561,175 B1 * 5/2003 Tidmore ..... 124/44.5
6,591,823 B1 * 7/2003 Keller ..... 124/44.5
6,634,349 B2 * 10/2003 Mizek et al. ..... 124/44.5
6,637,419 B1 * 10/2003 Troncoso, Jr. et al. ..... 124/44.5
6,662,796 B2 * 12/2003 St. Cyr ..... 124/44.5
6,684,871 B1 * 2/2004 Troncoso et al. ..... 124/44.5
6,739,321 B1 * 5/2004 Puchlerz ..... 124/44.5
6,772,747 B1 * 8/2004 Vastag ..... 124/44.5
6,789,535 B1 * 9/2004 McIntyre ..... 124/44.5
6,814,068 B1 * 11/2004 Troncoso et al. ..... 124/44.5
6,823,856 B2 * 11/2004 Rager ..... 124/44.5
6,938,615 B1 * 9/2005 Walker et al. ..... 124/44.5
6,978,775 B2 * 12/2005 Graf ..... 124/44.5
6,994,080 B1 * 2/2006 Yoder ..... 124/44.5
7,021,301 B2 * 4/2006 Nagle ..... 124/44.5
7,311,099 B2 * 12/2007 Rager ..... 124/44.5
7,409,950 B2 * 8/2008 Ellig et al. ..... 124/44.5
2002/0059926 A1 * 5/2002 Pinto, Jr. ..... 124/44.5
2004/0134474 A1 * 7/2004 Graf ..... 124/44.5
2005/0126554 A1 * 6/2005 Minica et al. ..... 124/44.5
2005/0139201 A1 * 6/2005 Nagle ..... 124/44.5
2006/0027222 A1 * 2/2006 Yoder ..... 124/44.5
2007/0119439 A1 * 5/2007 Mizek ..... 124/44.5
2007/0163560 A1 * 7/2007 Mertens ..... 124/44.5
2008/0105244 A1 * 5/2008 Rager ..... 124/44.5
2009/0183720 A1 * 7/2009 Hudkins ..... 124/44.5
2010/0175675 A1 * 7/2010 Roberts et al. ..... 124/25.6

* cited by examiner

ARROW REST

CROSS REFERENCE TO RELATED APPLICATION

This application claims the benefit of U.S. Provisional Patent Application Ser. No. 60/881,736, filed 18 Jan. 2007.

BACKGROUND OF THE INVENTION

1. Field of the Invention

This invention relates to an arrow rest that captures an arrow shaft within a frame prior to launch.

2. Description of Prior Art

Some conventional arrow rests, often referred to as shoot-thru arrow rests, allow an arrow to discharge without the fletching or the vanes touching the arrow rest. For example, U.S. Pat. Nos. 5,137,006 and 5,285,764 each disclose two opposing support arms through which one vane may pass during discharge of the arrow.

Other conventional arrow rests support an arrow shaft at two positions lower than the centerline of the arrow shaft. For example, U.S. Pat. Nos. 3,865,096, 3,935,854, 4,686,956, 4,748,964 and 4,827,895 teach supporting members that form point contact or line contact with an arrow shaft at two positions lower than a center-line of the arrow shaft. In such conventional arrow rests, the fletching or vane does not pass through supporting members of the arrow rest but rather clears the arrow rest.

Most archery arrows have three vanes mounted on an external surface of the arrow shaft. The three vanes are usually positioned with approximately 120° spacing between the vanes.

Once set in a particular position, many conventional arrow rests that allow the fletching to clear the arrow rest can accommodate only one size of arrow shaft diameter. But because arrow shafts are now manufactured with outside diameter lengths in a wide range, it is often necessary to make complicated and time-consuming mechanical adjustments to the arrow rest when changing to an arrow shaft with a different diameter. It is apparent there is a need for one arrow rest that can quickly and easily accommodate different diameters of differently sized arrow shafts. There is a further need for an arrow rest that can maintain an arrow shaft in a loaded position reliably and repeatedly.

SUMMARY OF THE INVENTION

It is one object of this invention to provide an arrow rest that does not interfere with the fletching or vanes of an arrow, as the arrow discharges over the arrow rest.

It is another object of this invention to provide an arrow rest that has relatively minimal frictional contact with an arrow shaft which the arrow rest supports.

It is yet another object of this invention to provide an arrow rest that can quickly and easily accommodate different diameters of differently sized arrow shafts.

The above and other objects are accomplished with different preferred embodiments of an arrow rest according to this invention.

An arrow rest according to a preferred embodiment of this invention is used in association with an archery bow to maintain a position of an arrow prior to and during launch of the arrow.

The arrow rest preferably includes a frame connected with respect to the archery bow, such as through a bracket. The frame may include two opposing ends defining an opening that permits passage of an arrow shaft when loading the arrow shaft within the arrow rest. The frame includes a configuration that, upon arrow launch, permits passage of the arrow shaft and arrow fletching through a pass-through.

According to one preferred embodiment of this invention, a vertical post may extend upwardly from the frame and preferably maintains a fixed vertical position of the arrow shaft within the frame, particularly during launch of the arrow. The vertical post may be adjustable upwards and downwards depending upon a diameter of the arrow shaft.

The arrow rest according to a preferred embodiment of this invention further includes a pair of spring arms that extend from the frame. Each spring arm includes an fixed end attached to the frame and a distal end within the pass-through. When the arrow shaft is inserted into the frame and on the vertical post, each spring arm contacts a portion of the arrow shaft thereby maintaining the arrow shaft in position within the arrow rest. The spring arms are preferably constructed of a generally flexible or spring-like material so as to not detrimentally interfere with the discharge of the arrow shaft from the arrow rest.

According to a preferred embodiment of this invention, the arrow rest may further include a pair of generally rigid members, each extending from the frame in a similar manner as the spring arms. Preferably, each rigid member includes a distal end that terminates at a distance away from the distal end of the respective spring arm. In the configuration of the arrow rest as described, the rigid members maintain the arrow shaft within a vicinity of the vertical post and prevent the arrow shaft from falling out of a generally ready position, particularly preventing the arrow shaft from clattering against the frame and/or falling completely out of the arrow rest.

According to another preferred embodiment of this invention, brushes and/or rollers may be connected relative to a frame to permit maintenance of arrow shaft within arrow rest. In addition, the frame may be biased into a first position prior to launch of an arrow and a second position subsequent to launch of the arrow. Preferably, the launch of the arrow urges the frame from the first position to the second position.

BRIEF DESCRIPTION OF THE DRAWINGS

The above-mentioned and other features and objects of this invention will be better understood from the following detailed description when taken in view of the drawings wherein.

DESCRIPTION OF PREFERRED EMBODIMENTS

FIGS. 1-8 and 14 show arrow rest 10 according to various preferred embodiments of this invention. Arrow rest 10 is preferably used to maintain arrow shaft 100, such as shown in FIGS. 4-8, in a fixed position prior to and during launch of the arrow.

Figure 1:
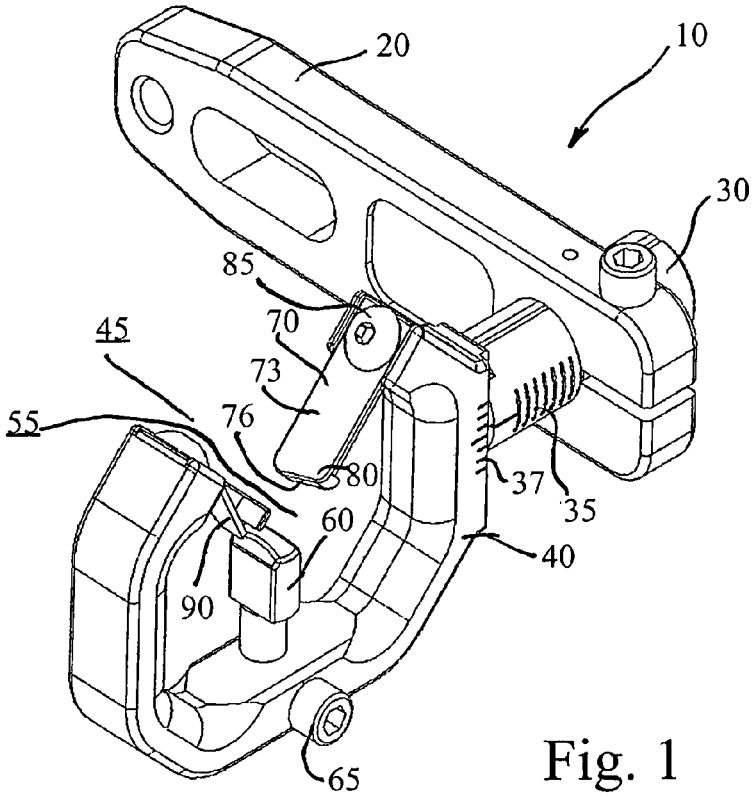
FIG. 1 is a perspective view of an arrow rest, according to one preferred embodiment of this invention.

Referring to FIG. 1, arrow rest 10 is shown in a perspective view. Arrow rest 10 is preferably attached with respect to an archery bow in a manner known to those having ordinary skill in the art. According to one preferred embodiment of this invention, bracket 20 is connected with respect to the archery bow to maintain arrow rest 10 in a generally fixed position relative to the archery bow. Bracket 20 is preferably generally rigid and configured to support arrow rest 10 and arrow shaft 100.

Arrow rest 10 preferably further includes frame 40 connected with respect to bracket 20. According to a preferred embodiment of this invention, frame 40 includes two opposing ends 42 defining opening 45. Opening 45 preferably permits passage of arrow shaft 100 when loading arrow shaft 100 within arrow rest 10 before nocking the arrow in the archery bow. As such, frame 40 preferably includes opening 45 for insertion and loading of arrow shaft 100 and pass-through 45 through which arrow shaft 100 is launched.

Figure 2:
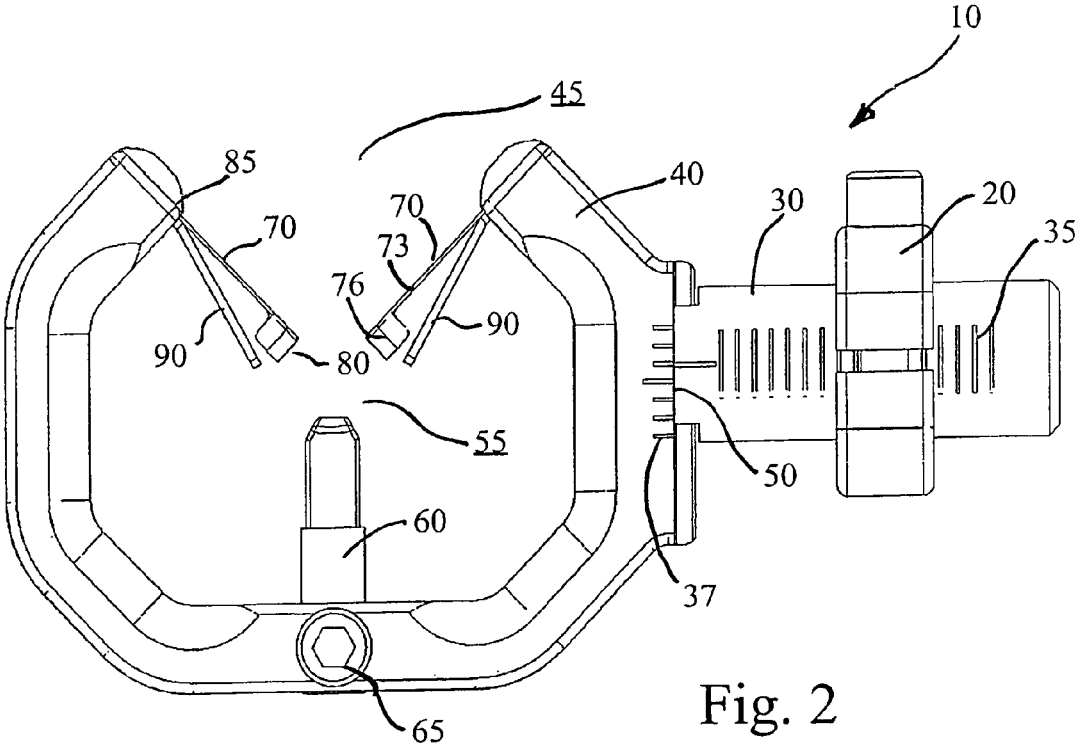
FIG. 2 is a front view of the arrow rest shown in FIG. 1.

According to one preferred embodiment of this invention, such as shown in FIG. 2, frame 40 may comprise a generally octagonal configuration with opening 45 positioned within a top section of frame 40. Frame 40 may otherwise include any other suitable configuration that permits passage of arrow shaft 100 therethrough.

According to a preferred embodiment of this invention, mounting shaft 30 extends between frame 40 and bracket 20. Mounting shaft 30 is preferably rotationally adjustable relative to bracket 20 to permit adjustment of a launch angle, and thus a desired trajectory, of the arrow from arrow rest 10.

In addition, mounting shaft 30 may be laterally slideable relative to bracket 20 so as to properly align arrow shaft 100 within the archery bow. Accordingly, mounting shaft 30 may include a plurality of lateral gradations 35 lining up a lateral position of mounting shaft 30 relative to bracket 20. In this manner, arrow rest 10 may be positioned and configured in a desired and/or repeatable position relative to the archery bow.

Further, frame 40 may be vertically adjustable relative to mounting shaft 30. Vertical adjustment screw (not shown) may be positioned within an end of mounting shaft 30 thereby permitting setting a vertical height of frame 40 relative to mounting shaft 30 and/or bracket 20. Accordingly, vertical gradations 37 may be positioned along frame 40 and/or mounting shaft 30 to position and configure arrow rest 10 in a desired and/or repeatable position relative to the archery bow.

Many conventional arrow rests allow a component, such as a mounting shaft, to rotate with respect to the archery bow prior to and/or during launch of the arrow. Arrow rest 10 according to this invention preferably operates in a generally stationary manner relative to arrow shaft 100 and the archery bow.

According to one preferred embodiment of this invention, vertical post 60 extends upwardly from frame 40 and preferably maintains a fixed vertical position within frame 40, particularly during launch of the arrow. Frame 40 at least partially encircles vertical post 60 and, thus, at least partially encircles arrow shaft 100, such as shown in FIGS. 4 and 5.

Figure 4:
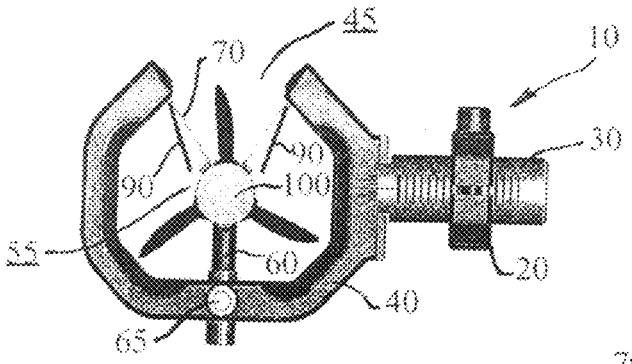
FIG. 4 is front view of an arrow rest having a nocked arrow with a large diameter arrow shaft, according to one preferred embodiment of this invention.
Figure 5:
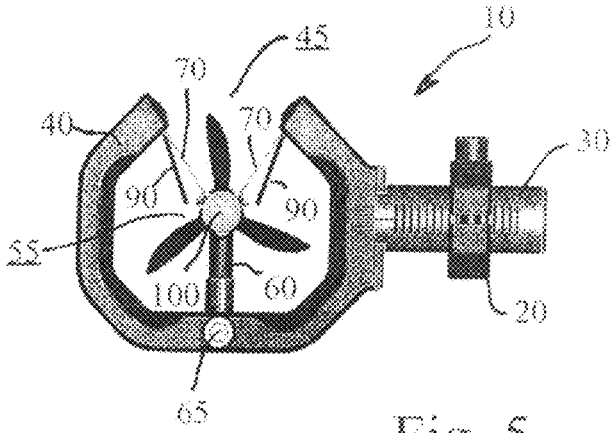
FIG. 5 is a front view of an arrow rest having a nocked arrow with a small diameter arrow shaft, according to one preferred embodiment of this invention.
Figure 6:
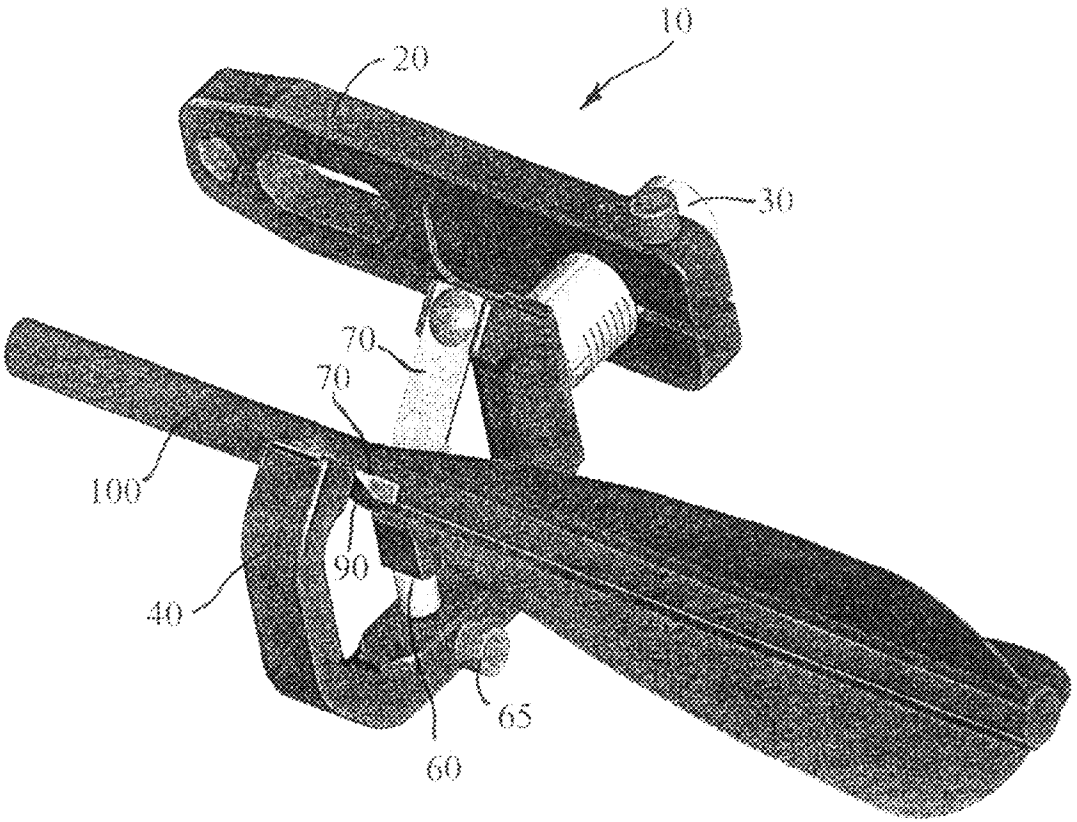
FIG. 6 is a perspective view of an arrow rest having a nocked arrow, according to one preferred embodiment of this invention.
Figure 7:
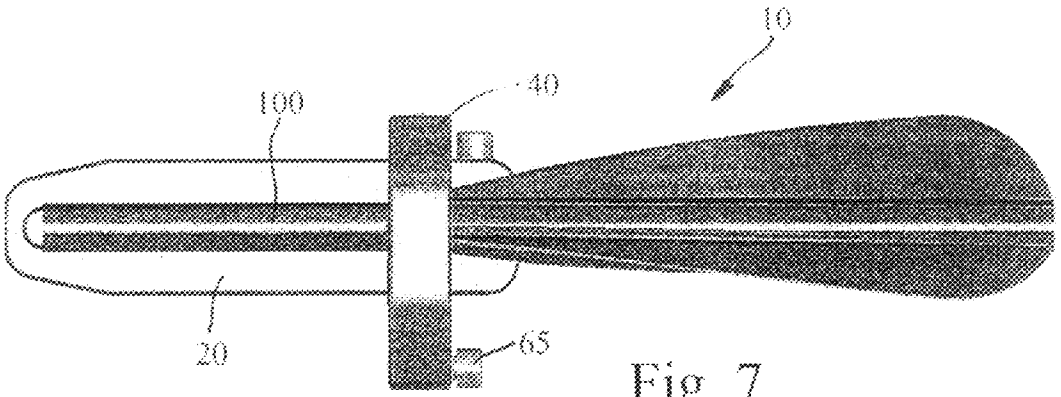
FIG. 7 is a side view of the arrow rest shown in FIG. 6.
Figure 8:
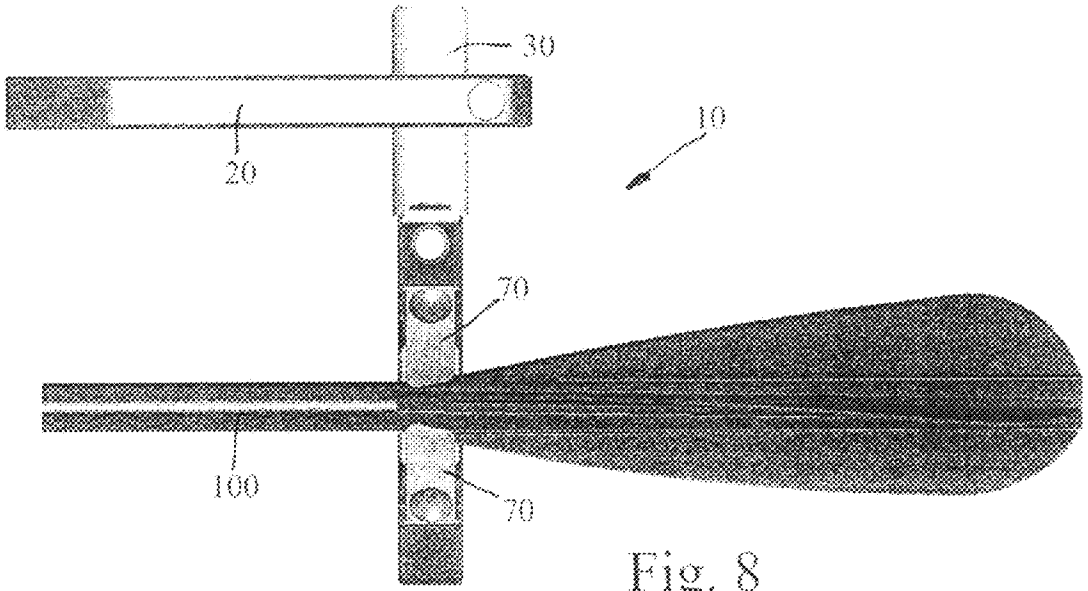
FIG. 8 is a top view of the arrow rest shown in FIG. 6.

As further shown in FIGS. 4 and 5, set screw 65 may be connected relative to vertical post 60 and engageable with vertical post 60 for adjusting a fixed height of vertical post 60. As shown in FIG. 4, vertical post 60 may be adjustable downward to accommodate arrow shaft 100 having a larger diameter, such as shown in FIG. 4, and may be adjustable upward to accommodate arrow shaft 100 having a smaller diameter, such as shown in FIG. 5.

Arrow rest 10 further includes a pair of spring arms 70 that extend from frame 40. Each spring arm 70 preferably includes an attached position on frame 40 and a distal end 80 within pass-through 55. One spring arm 70 is preferably positioned or fixed to each side of frame 40. Each spring arm 70 preferably extends from an end of frame 40 adjacent opening 45 and includes distal end 80 positioned at a distance from vertical post 60 approximately equal to a diameter of arrow shaft 100. As such, when arrow shaft 100 is inserted into frame 40 and on vertical post 60, each spring arm 70 contacts a portion of arrow shaft 100 thereby maintaining arrow shaft 100 in position within arrow rest 100.

Spring arms 70 are preferably constructed of a generally flexible or spring-like material so as to permit insertion of arrow shaft 100 and yet not detrimentally interfere with the discharge of arrow shaft 100 from arrow rest 10.

As shown in FIGS. 4 and 5, each spring arm 70 preferably includes a first portion 73 extending generally toward vertical post 60 and second portion 76 extending at an angle from first portion 73 and in a direction generally tangent to arrow shaft 100 in a mounted position on vertical post 60. Preferably, second portion 76 of spring arm 70 is biased against arrow shaft 100 sufficient to maintain a position of arrow shaft 100 on vertical post 60. In this manner, arrow shaft 100 having a first diameter, such as shown in FIG. 4, may be inserted in arrow rest 10 and, following adjustment of vertical post 60, arrow shaft 100 having a second, smaller diameter, such as shown in FIG. 5, may be inserted into the same arrow rest 10. In each size of arrow shaft 100, the flexibility of spring arms 70 assists in maintaining a fixed and ready position of the arrow within arrow rest 10.

According to a preferred embodiment of this invention, arrow rest 10 further includes a pair of generally rigid members 90, each extending from frame 40 in a similar manner as spring arms 70. Preferably, each rigid member 90 extends adjacent opening 45 and at a distance below a respective spring arm 70. Each generally rigid member 90 preferably extends from an attached position the same or similar in location as the attached position of spring arms 70. As such, each spring arm 70 and each generally rigid member 90 preferably extends generally into pass-through 55.

As shown in FIG. 2, each rigid member 90 is preferably approximately as long as each spring arm 70. In the configuration of arrow rest 10 as described, rigid member 90 maintains arrow shaft 100 within a vicinity of vertical post 60 and prevents arrow shaft 100 from falling out of a generally ready position and particularly prevents arrow shaft 100 from clattering against frame 40 and/or falling completely out of arrow rest 10.

Figure 3:
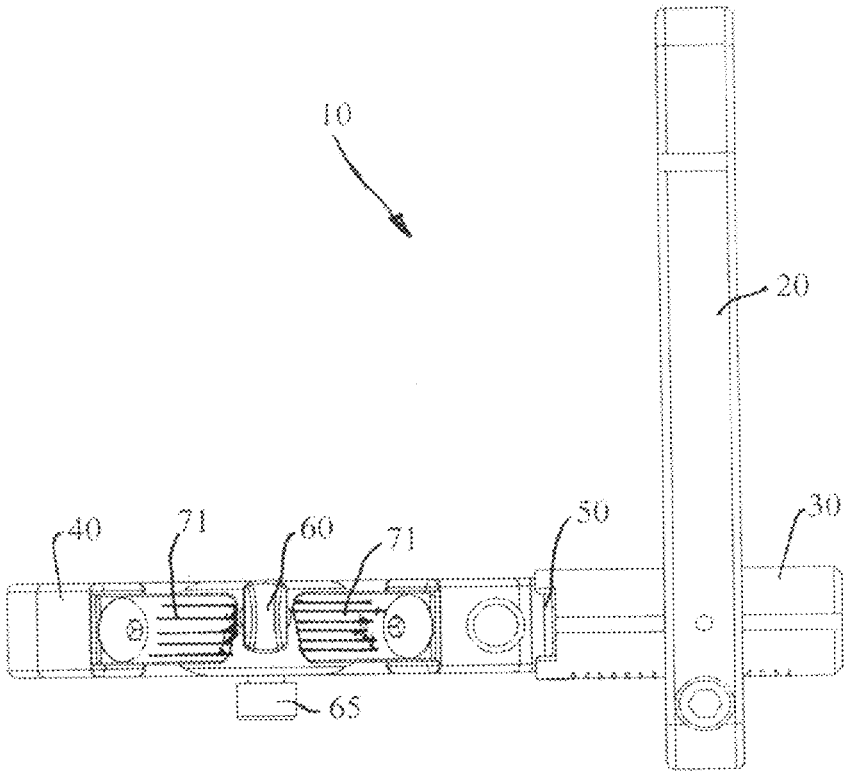
FIG. 3 is a top view of an arrow rest, according to one preferred embodiment of this invention.
Figure 14:
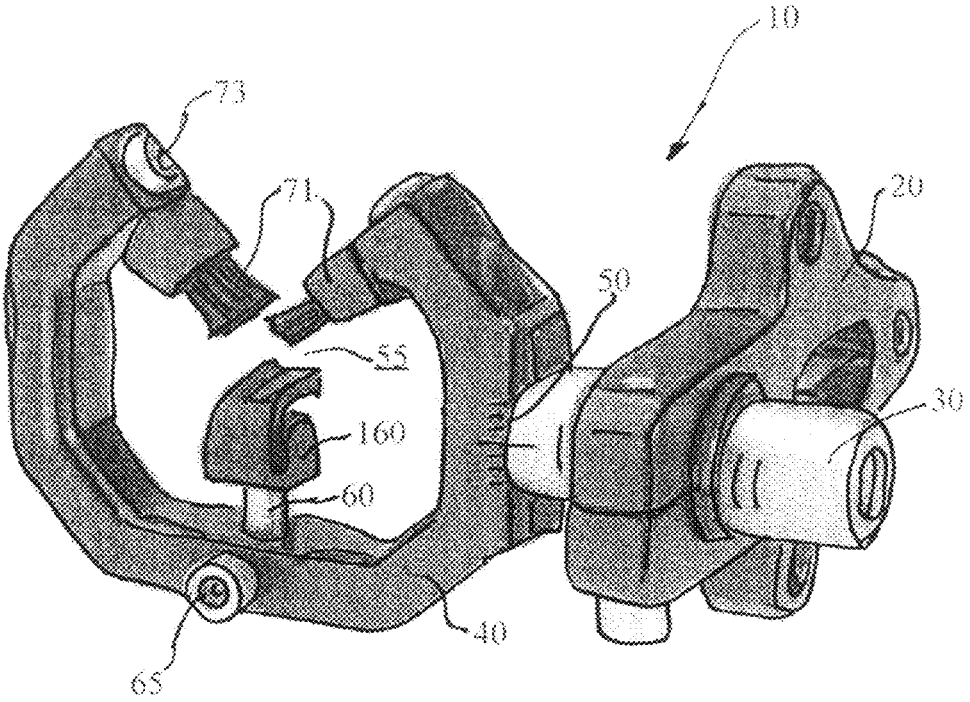
FIG. 14 is a front perspective view of an arrow rest, according to one preferred embodiment of this invention.

As shown in FIGS. 3 and 14, according to one preferred embodiment of this invention, arrow rest 10 may include brushes 71 attached to frame 40. In a similar manner as spring arm 70, brushes 71 may contact arrow shaft 100 and maintain arrow shaft 100 in position within arrow rest 10. Each brush 71 preferably extends into opening 55 at an angle relative to vertical post 60. Each brush 71 is preferably additionally removably attached to frame 40 with fastener 43. As a result, brush 71 may be removed and replaced when worn and/or broken.

As further shown in FIG. 14, vertical post 60 may further include rest 160 which may be constructed and arranged so as to provide flexibility and/or a biasing action relative to a fixed position of vertical post 60.

According to a preferred embodiment of this invention, when arrow shaft 100 is positioned in arrow rest 10, each spring arm 70 contacts a portion of arrow shaft 100 and each generally rigid member 90 is spaced at a distance from arrow shaft 100.

FIGS. 9-13 show additional preferred embodiments of this invention. As shown in FIGS. 9-13, arrow rest 300 preferably includes bracket 305 connected with respect to the archery bow in a similar manner as described above. In addition, arrow rest 300 further includes frame 310 connected with respect to bracket 305, such as through shaft 312. As described below, frame 310 may be rotatable relative to bracket 305, such as through shaft 312. Frame 310 preferably includes two ends 315 defining opening 345. In addition, vertical support 320 preferably extends upward from frame 310 so that frame 310 at least partially encircles vertical support 320.

Figure 9:
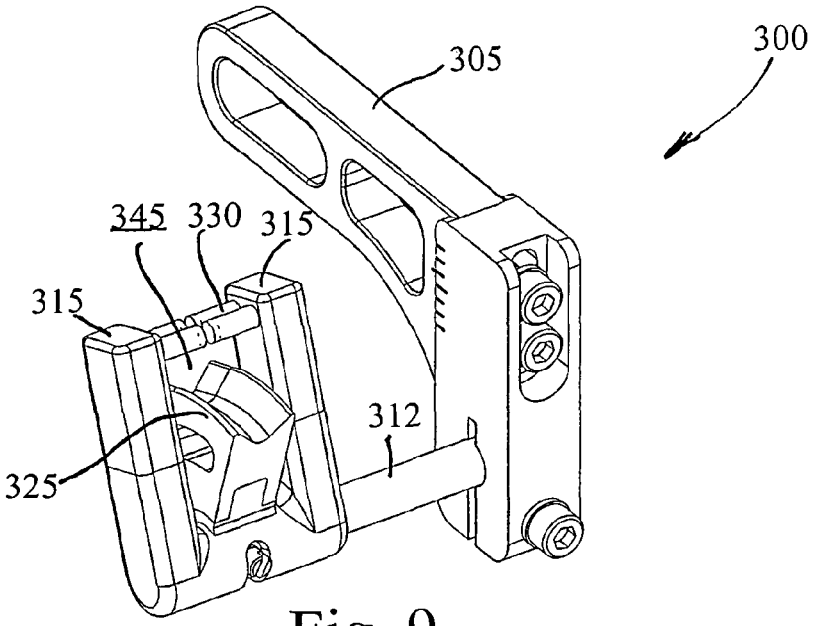
FIG. 9 is a front perspective view of an arrow rest according to one preferred embodiment of this invention.
Figure 10:
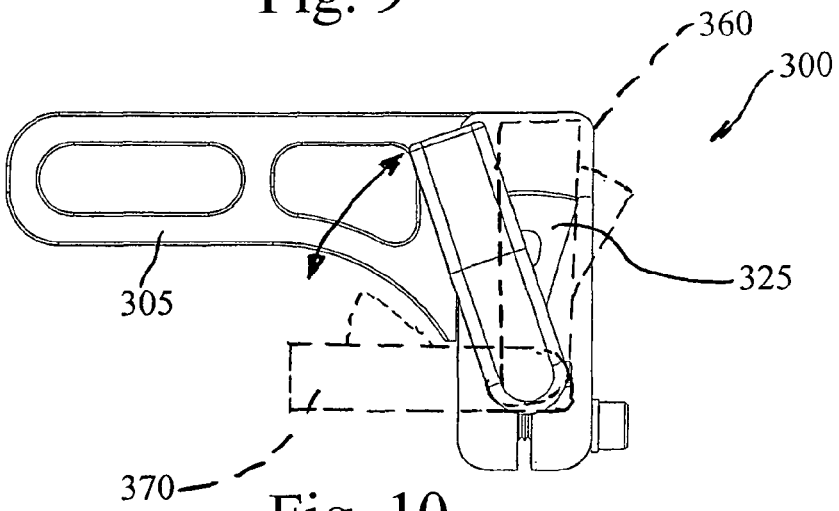
FIG. 10 is a side view of the arrow rest shown in FIG. 9.
Figure 11:
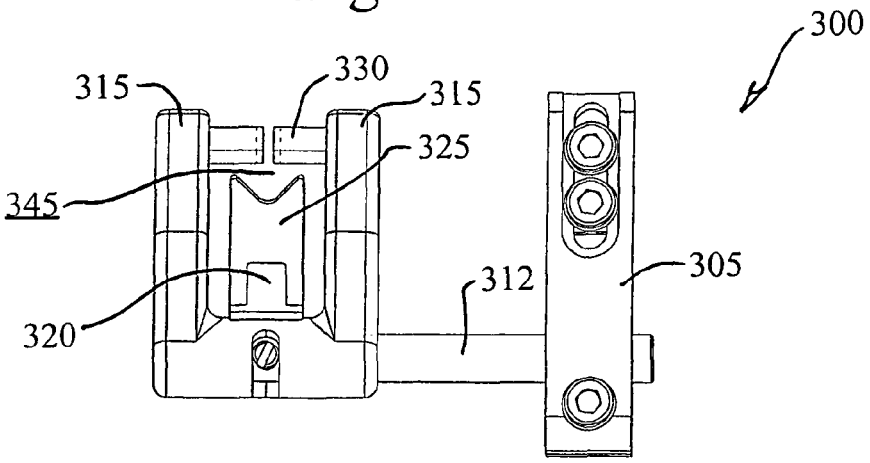
FIG. 11 is a front view of the arrow rest shown in FIG. 9.

According to a preferred embodiment of this invention shown in FIGS. 9-11, brushes 330 preferably extend from ends 315 of frame 310 and toward vertical support 320. Brushes 330 are preferably sized and positioned to maintain arrow shaft 100 in position within arrow rest 300 and on vertical support 320.

Figure 12:
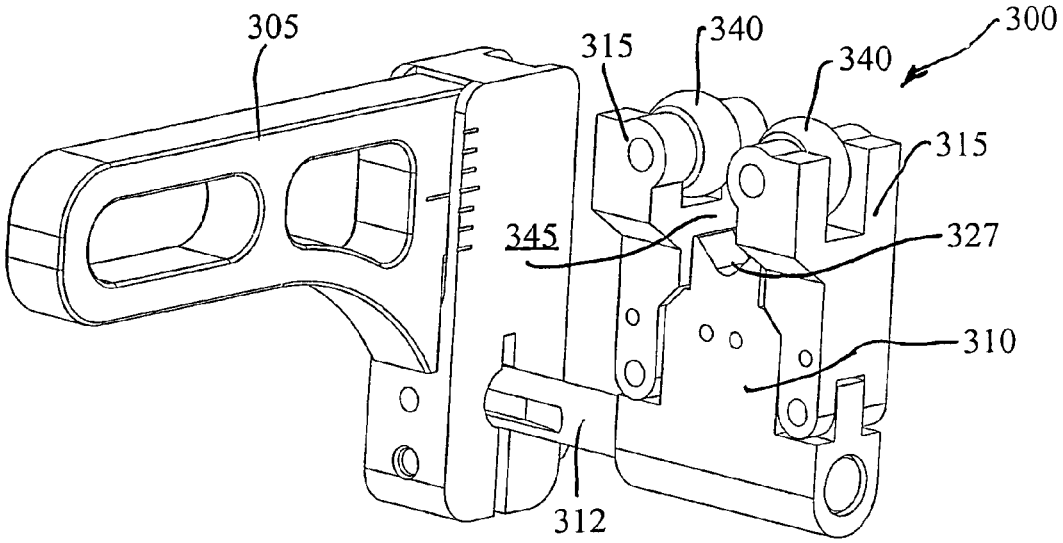
FIG. 12 is a rear perspective view of an arrow rest according to one preferred embodiment of this invention.
Figure 13:
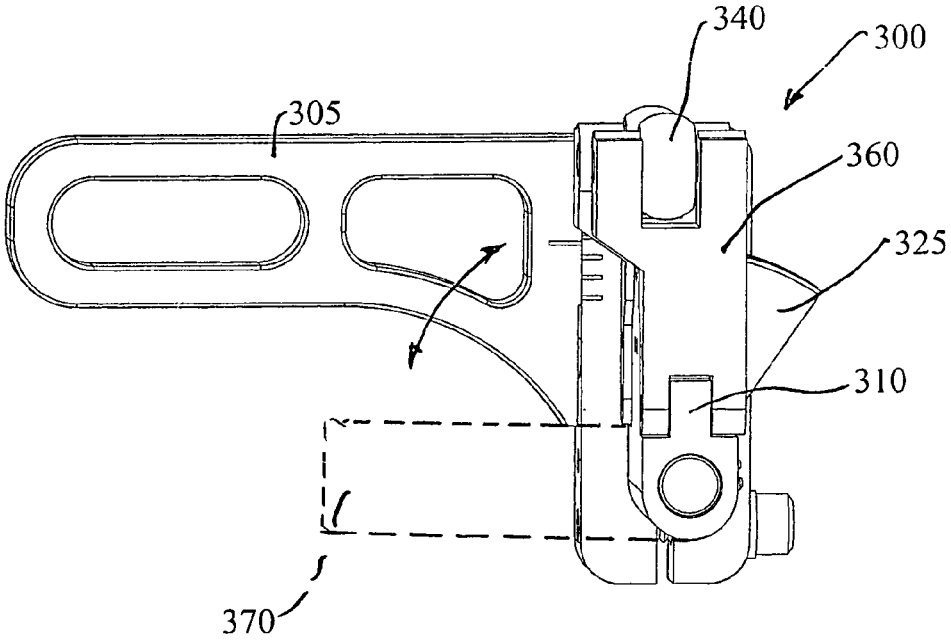
FIG. 13 is a side view of the arrow rest shown in FIG. 12.

In addition, as shown in FIGS. 9-11, vertical support 320 may further include arcuate surface 325 extending through opening 345. Arcuate surface 325 preferably extends tangentially to intended path of arrow shaft 100. As shown in FIGS. 12 and 13, vertical support may further include a V-shaped rest 327 through which arrow shaft 100 may extend and rest.

According to a preferred embodiment of this invention shown in FIGS. 12 and 13, rollers 340 are preferably positioned at ends 315 of frame 310 and toward vertical support 320. Rollers 340 may be rigidly attached with respect to frame 310 or may freely rotate relative to frame 310.

As best shown in FIGS. 10 and 13, frame 310 is preferably rotatable between a first position 360 before arrow shaft 100 is fired and a second position 370, following release or launch of arrow shaft 100. Preferably, though not necessarily, first position 370 is approximately 90 degrees rotation from second position 360. In operation, arrow shaft 100 is at rest on the arrow rest 300 in first position 360, such as a generally vertical position relative to bracket 305. As arrow shaft 100 is launched, frame 310 preferably rotates out of first position 360 and away from interference with arrow shaft 100 into second position 370. Arcuate surface 325 of vertical support 320, as shown in FIGS. 9-11, may urge frame 310 toward second position 370 as arrow shaft 100 is launched, specifically as arrow shaft 100 passes over arcuate surface 325.

According to a preferred embodiment of this invention, frame 310 is biased into both the first position 360 as it is reset to the first position 360 and the second position 370 as arrow shaft 100 is released. Depending on the inertia or mechanical assistance involved, frame 310 is preferably always biased toward either first position 360 or second position 370 and, as such, will not remain in a static position between first position 360 and second position 370. One or more springs or similar bias elements (not shown) may be connected with respect to frame 310 and/or shaft 312 to bias frame 310 into first position 360 and/or second position 370.

Following launch of arrow shaft 100, frame 310 may be reset to first position 360 by the user. Frame 310 is then biased into first position 360 by one or more bias elements (not shown) until arrow shaft 100 is launched again.

While in the foregoing specification this invention has been described in relation to certain preferred embodiments thereof, and many details have been set forth for purpose of illustration, it will be apparent to those skilled in the art that the invention is susceptible to additional embodiments and that certain of the details described can be varied considerably without departing from the basic principles of the invention.

We claim:

1. An arrow rest for an archery bow, the arrow rest comprising:

a bracket connected with respect to the archery bow;

a frame connected with respect to the bracket, the frame having two ends defining an opening;

a fixed vertical post extending upwardly from the frame, the frame at least partially encircling the fixed vertical post;

a set screw engageable with the fixed vertical post for adjusting a fixed height of the fixed vertical post to accommodate arrow shafts of larger and smaller diameters;

a rest positioned at a distal end of the fixed vertical post, the rest flexible with respect to the fixed vertical post and having an arcuate surface for supporting an arrow shaft;

a pair of brushes, each brush of the pair extending from an end of the frame adjacent the opening, each brush having a distal end positioned at a distance from the fixed vertical post approximately equal to a diameter of the arrow shaft; and a mounting shaft connecting the frame with the bracket, the mounting shaft rotationally and slidably adjustable relative to the bracket.

2. The arrow rest of claim 1 wherein the mounting shaft includes a plurality of gradations for positioning the mounting shaft in a repeatable position relative to the bracket.

3. The arrow rest of claim 1 wherein the frame comprises a generally octagonal configuration with the opening at a top section of the frame.

4. An arrow rest for an archery bow, the arrow rest comprising:

a bracket connected with respect to the archery bow;

a frame connected with respect to the bracket, the frame having two ends defining an opening;

a fixed vertical post extending upwardly from the frame, the frame at least partially encircling the fixed vertical post;

a rest positioned at a distal end of the fixed vertical post, the rest flexible with respect to the fixed vertical post and having an arcuate surface for supporting an arrow shaft;

a set screw engageable with the fixed vertical post for adjusting a fixed height of the fixed vertical post to accommodate arrow shafts of larger and smaller diameters;

a pair of brushes, each brush of the pair extending from an end of the frame adjacent the opening and at an angle relative to the fixed vertical post; and a mounting shaft connecting the frame with the bracket, the mounting shaft rotationally and slidably adjustable relative to the bracket.

5. The arrow rest of claim 4 wherein each brush includes a distal end positioned at a distance from the fixed vertical post approximately equal to a diameter of an arrow shaft.

6. The arrow rest of claim 4 wherein each brush is removably attached to the frame with a fastener.

7. An arrow rest for an archery bow, the arrow rest comprising:

a frame;

a fixed vertical post extending upwardly from the frame, the frame at least partially encircling the fixed vertical post to form an arrow shaft pass-through;

a rest positioned at a distal end of the fixed vertical post, the rest flexible with respect to the fixed vertical post and having an arcuate surface along an axis of an arrow shaft for supporting the arrow shaft;

a set screw engageable with the fixed vertical post for adjusting a fixed height of the fixed vertical post to accommodate arrow shafts of larger and smaller diameters;

a pair of brushes removably attached to the frame, each brush of the pair extending from an attached position on the frame at an angle relative to the fixed vertical post and generally toward the arrow shaft pass-through;

a bracket connected with respect to the archery bow; and a mounting shaft connected between the bracket and the frame, the mounting shaft slidable with respect to the bracket.

8. The arrow rest of claim 7 further comprising:

an opening formed between two ends of the frame.

9. The arrow rest of claim 7 wherein, when an arrow shaft is positioned in the arrow rest, each brush contacts a portion of the arrow shaft.

* * * * *